US010751863B1

(12) United States Patent
Litzinger

(10) Patent No.: US 10,751,863 B1
(45) **Date of Patent: *Aug. 25, 2020**

(54) BIRDS BEAK ELASTOMER FASTENER MAGAZINE FEEDER

(71) Applicant: W. C. Litzinger, Springdale, AR (US)

(72) Inventor: W. C. Litzinger, Springdale, AR (US)

( * ) Notice: Subject to any disclaimer, the term of this patent is extended or adjusted under 35 U.S.C. 154(b) by 289 days.

This patent is subject to a terminal disclaimer.

(21) Appl. No.: 15/875,408

(22) Filed: Jan. 19, 2018

Related U.S. Application Data

(63) Continuation-in-part of application No. 14/201,155, filed on Mar. 7, 2014, now Pat. No. 9,908,226, which is a continuation-in-part of application No. 13/766,236, filed on Feb. 13, 2013, now Pat. No. 9,649,756.

(60) Provisional application No. 61/774,298, filed on Mar. 7, 2013, provisional application No. 61/633,533, filed on Feb. 13, 2012.

(51) Int. Cl.
*B25C 1/00* (2006.01)
*B25C 7/00* (2006.01)

(52) U.S. Cl.
CPC ..... *B25C 1/003* (2013.01); *B25C 7/00* (2013.01)

(58) Field of Classification Search
CPC .. F16B 15/06; B25C 1/14; B25C 7/00; B23Q 7/10
USPC ..... 227/119, 120, 136; 411/493, 500
See application file for complete search history.

(56) References Cited

U.S. PATENT DOCUMENTS

| | | | | |
|---|---|---|---|---|
| 4,523,646 | A | 6/1985 | Doyle et al. | 173/15 |
| 4,550,643 | A | 11/1985 | Schwartzenberger | 91/356 |
| 4,606,455 | A | 8/1986 | Grikis et al. | 206/347 |
| 5,267,682 | A | 12/1993 | Okouchi | 227/151 |
| 5,662,257 | A | 9/1997 | Mukoyama et al. | 227/8 |
| 5,669,541 | A | 9/1997 | Ronconi | 227/8 |
| 5,785,228 | A | 7/1998 | Fa et al. | 227/8 |
| 5,816,469 | A * | 10/1998 | Ohuchi | B25C 1/005 227/119 |
| 6,116,488 | A | 9/2000 | Lee | 227/8 |
| 6,161,744 | A | 12/2000 | Mukoyama et al. | 227/8 |
| 6,209,770 | B1 | 4/2001 | Perra | 228/8 |
| 6,604,665 | B2 | 8/2003 | Gabriel | 227/120 |
| 7,575,140 | B2 | 8/2009 | Jiang | 227/110 |
| 7,641,088 | B2 | 1/2010 | Wang | 227/119 |
| 7,874,469 | B2 | 1/2011 | Liu | 227/142 |
| 7,886,950 | B2 | 2/2011 | Lin et al. | 227/148 |
| 7,931,180 | B2 | 4/2011 | Lai | 227/8 |
| 8,091,757 | B1 | 1/2012 | Jian et al. | 227/120 |
| 8,127,974 | B2 | 3/2012 | Zhang et al. | 227/133 |
| 8,267,295 | B2 | 9/2012 | Wu et al. | 227/8 |
| 8,348,116 | B2 | 1/2013 | Xu | 227/109 |
| 8,479,966 | B2 | 7/2013 | Chien et al. | 227/131 |
| 8,646,672 | B2 | 2/2014 | Wu et al. | 227/119 |
| 9,908,226 | B1 * | 3/2018 | Litzinger | B25C 1/003 |
| 2006/0118594 | A1 | 6/2006 | Chen | 227/120 |
| 2008/0105725 | A1 * | 5/2008 | Tamura | B25B 21/023 227/119 |

(Continued)

*Primary Examiner* — Nathaniel C Chukwurah
(74) *Attorney, Agent, or Firm* — Keisling & Pieper PLC; David B. Pieper

(57) ABSTRACT

A fastener driving tool magazine and nose piece for use with a fastener with a preinstalled elastomer beneath the head of the fastener. A magazine structure for avoiding damage to the elastomer is taught and a birds beak fastener guide is taught for installing the fastener while still avoiding damage to the elastomer.

2 Claims, 6 Drawing Sheets

(56) References Cited

U.S. PATENT DOCUMENTS

| | | | | |
|---|---|---|---|---|
| 2009/0026244 | A1 | 1/2009 | Huang | 227/119 |
| 2009/0050667 | A1 | 2/2009 | Po | 227/120 |
| 2010/0230463 | A1 | 9/2010 | Yang | 227/109 |
| 2011/0305540 | A1* | 12/2011 | Litzinger | F16B 15/06 411/386 |

* cited by examiner

BIRDS BEAK ELASTOMER FASTENER MAGAZINE FEEDER

CROSS-REFERENCE TO RELATED APPLICATIONS

This application claims priority to and is a continuation-in-part of U.S. patent application Ser. No. 14/201,155, filed on Mar. 7, 2014 entitled BIRDS BEAK ELASTOMER FASTENER MAGAZINE FEEDER which is a continuation-in-part of U.S. Patent Application Ser. No. 61/774,298, filed on Mar. 7, 2013 entitled NAIL FASTENER MAGAZINE; U.S. patent application Ser. No. 14/201,155, filed on Mar. 7, 2014 entitled BIRDS BEAK ELASTOMER FASTENER MAGAZINE FEEDER is also a continuation-in-part of U.S. patent application Ser. No. 13/766,236, filed on Feb. 13, 2013 entitled PNEUMATIC NAILER OUTRIGGER STABALIZING FOOT which is a continuation-in-part of U.S. Patent Application Ser. No. 61/633,533, filed on Feb. 13, 2012 entitled FOOT CONTROLLED FASTENER DRIVING TOOL which are all hereby incorporated by reference in their entirety.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention relates to the field of magazines for impact driveable fasteners. In particular, the present invention relates specifically to a magazine and guide drive nose for an elastomer inclusive fastener.

2. Description of the Known Art

As will be appreciated by those skilled in the art, pneumatic or gas driven nailers have been known for an extended period of time. However, the ability to drive a fastener with an integrally mounted elastomer seal in a vertical position is not known. The present invention is directed to getting the elastomer through the magazine intact and installing it in a vertical position without damaging the elastomer.

Patents disclosing information relevant to fasteners, collating, magazines, and pneumatic, gas, and electrical drives for their installation include: United States Patent Application No. 20100230463A1 filed by Yang; Mingjun on Sep. 16, 2010 entitled Nail Box for T-shaped. L-shaped and U-shaped Nails of Nail-Shooting Gun; United States Patent Application No. 20090050667A1 filed by Po; Chien-Kuo on Feb. 26, 2009 entitled NAIL MAGAZINE; United States Patent Application No. 20090026244A1 field by HUANG; Po-Feng on Jan. 29, 2009 entitled Driver Guiding Set for Power Nail Gun; United States Patent Application No. 20060118594A1 filed by Chen; Robert on Jun. 8, 2006 entitled Nailing gun with improved nail magazine; U.S. Pat. No. 8,646,672, issued to Wu, et al. on Feb. 11, 2014 entitled Nail positioning member of nail slot of nail gun; U.S. Pat. No. 8,479,966 issued to Chien. et al. on Jul. 9, 2013 entitled Floating impact apparatus for electrical nail gun; U.S. Pat. No. 8,348,116, issue to Xu on Jan. 8, 2013 entitled Nail gun adaptable to nails of different length; U.S. Pat. No. 8,267,295, issued to Wu, et al. on Sep. 18, 2012 entitled Combustion powered nail gun having safety mechanism; U.S. Pat. No. 8,127,974, issued to Zhang. et al. on Mar. 6, 2012, entitled Electrical motor driven nail gun; U.S. Pat. No. 8,091,752, issued to Jian, et al. on Jan. 10, 2012 entitled Nail gun with a nail guiding unit; U.S. Pat. No. 8,091,752, issued to Jian, et al. on Jan. 10, 2012 entitled Nail gun with a nail guiding unit; U.S. Pat. No. 7,931,180, issued to Lai on Apr. 26, 2011 entitled Pneumatic nail gun; U.S. Pat. No. 7,886,950, issued to Lin, et al. on Feb. 15, 2011 entitled Nose assembly for a floor nail gun; U.S. Pat. No. 7,874,469, issued to Liu on Jan. 25, 2011 entitled Nailing depth adjustable device for a nail gun; U.S. Pat. No. 7,641,088 issued to Wang on Jan. 5, 2010 entitled Nail gun with nail alignment adjustment device; U.S. Pat. No. 7,575,140, issued to Jiang on Aug. 18, 2009 entitled Abutment adjusting device for nail gun; U.S. Pat. No. 6,604,665, issued to Gabriel on Aug. 12, 2003 entitled Pneumatic nailer coiled collation strip; U.S. Pat. No. 6,209,770, issue to Perra on Apr. 3, 2001 entitled Safety trip assembly and trip lock mechanism for a fastener driving tool; U.S. Pat. No. 6,116,488, issued to Lee on Sep. 12, 2000 entitled Trigger switching structure of contact/full sequential actuation fastening tool; U.S. Pat. No. 5,785,228, issued to Fa, et al. on Jul. 28, 1998 entitled Dual module pneumatic tool; U.S. Pat. No. 5,669,541, issued to Ronconi on Sep. 23, 1997 entitled Release mechanism with safety device for compressed-air nail firing tools; U.S. Pat. No. 4,606,455, issued to Grikis, et al. on Aug. 19, 1986 entitled Collated fastener strip; and U.S. Pat. No. 4,550,643, issued to Schwartzenberger on Nov. 5, 1985 entitled Fastener driving tool. Each of these patents is hereby expressly incorporated by reference in its entirety.

U.S. Pat. No. 6,209,770, issue to Perra on Apr. 3, 2001 entitled Safety trip assembly and trip lock mechanism for a fastener driving tool. The abstract describes A fastener driving tool includes a housing assembly with a nosepiece assembly defining a drive track. A driving mechanism is housed within the housing assembly to drive a fastener through the drive track and into a workpiece in response to a trigger. The tool includes a safety trip assembly which includes a trigger enabling portion and a workpiece engaging portion and is movable between an extended disabling position and a retracted enabling position. The safety trip assembly is biased toward the extended position and is moved toward the retracted position by engagement between the workpiece and the workpiece engaging member. The workpiece engaging portion is movable to permit adjustment of a length of the safety trip assembly. The safety trip assembly includes a coupling mechanism including a fixed locking structure formed on an exterior portion of the workpiece engaging portion and a manually operable locking mechanism. The locking mechanism is carried by the trigger enabling portion and includes a locking member mounting structure and has a manually operable locking member mounted thereon. The movable locking member is biased into a locking position, engaging the fixed locking structure and preventing relative movement between the workpiece engaging portion and the trigger enabling portion and may move into a releasing position disengaging the fixed locking structure and permitting such relative movement. A user may manually move the locking mechanism against the bias by engaging the movable locking member and moving it from the locking position to the releasing position.

U.S. Pat. No. 6,116,488, issued to Lee on Sep. 12, 2000 entitled Trigger switching structure of contact/full sequential actuation fastening tool. The abstract describes a trigger switching structure of a contact/full sequential actuation fastening tool, being used in a trigger pivotally mounted between a safety yoke and a trigger valve both of the fastening tool, the switching structure is comprised at least of a receiving seat, a stop piece and a spring. The receiving seat is provided therein a positioning rod and a supporting rod, the stop piece is pivotally mounted on the receiving seat by the positioning rod, and the receiving seat can be combined with the trigger with the supporting rod; the spring is mounted straddling the trigger and the receiving seat to allow a user to move the receiving seat to change the contact position of the stop piece and the safety yoke of the fastening tool to choose a contact actuation or a full sequential actuation position desired for fastening. By embedding the above members in the trigger, occupied space can be reduced, and accidental touching for fastening can be effectively eliminated, safety of use of the fastening tool can thus be increased.

U.S. Pat. No. 5,785,228, issued to Fa, et al. on Jul. 28, 1998 entitled Dual mode pneumatic tool. The abstract describes a single cycle/multiple cycle dual mode pneumatically driven fastener driving tool utilizes a resettable valve, trigger apparatus, work contact element (WCE) and a mode selecting trigger blocking pin. With the pin in place, the trigger must be released then depressed for each tool actuation. The tool is actuated only when the WCE is also depressed but without regard to the sequence of trigger and WCE depression. In a multiple cycle mode, the pin is removed and the actuation valve is reset either by trigger extension, or by WCE extension for "bottom contact" operation. The tool can be activated by full trigger release and depression while the WCE is held against a work surface. No particular sequence of WCE and trigger depression is required in this second mode. Apparatus and methods are disclosed.

U.S. Pat. No. 5,669,541, issued to Ronconi on Sep. 23, 1997 entitled Release mechanism with safety device for compressed-air nail firing tools. The abstract describes a release mechanism for a compressed-air nail firing tool which includes a trigger that is adapted to act on a pilot valve shutter that activates the nail firing tool. A lever is mounted on the trigger and is operatively associated with a probe that detects the resting position of the nail firing tool on a part being treated. A stem is pivoted on the probe and, in cooperation with a cap that can be applied thereto and as a function of its orientation with respect to the lever, selects single-firing or repeated-firing operation of the nail firing tool.

U.S. Pat. No. 4,550,643, issued to Schwartzenberger on Nov. 5, 1985 entitled Fastener driving tool. The abstract describes a fastener driving tool includes a control assembly that allows the tool to be fired sequentially by first placing the tool against a workpiece followed by actuation of a trigger to fire the tool. The control assembly includes a valve assembly that allows the tool to be selectively adjusted to operate in a multi-shot sequence or a single shot sequence. In the single shot sequence the tool may only be actuated once upon placement of the tool against a workpiece and subsequent actuation of the trigger. The tool must be removed and repositioned on the workpiece before the tool can again be fired. In the multi-shot sequence, the tool may be repeatedly fired by repeated actuation of the trigger once the tool has been placed on the workpiece.

These prior art references teach basic magazine and driven fastener construction with spring buffered drive pins such that the present invention builds upon the basic knowledge of the prior art and is directed only to the inventive aspects. These prior art patents are very limited in their teaching and utilization, and an improved magazine assembly and drive nose are needed to overcome these limitations.

SUMMARY OF THE INVENTION

The present invention is directed to an improved fastener magazine and nose assembly for installation of a fastener with an elastomer installed under the head of the fastener. In accordance with one exemplary embodiment of the present invention, a birds beak fastener guide is described for use with the fastener magazine. The bird beak fastener guide uses an outer housing that defines an upper mounting aperture and a lower nose extension. The upper mounting aperture is used to retain an inner sliding support body. The inner sliding support body is used to pivotally mount guide fingers. The guide fingers include inner guide surfaces that have a length sufficient to only contact the shank and the edge of the head of the fastener so that the elastomer is not marred during firing of the fastener. The prior art spring probes are connected to the outer housing and the movement of the outer housing upon contacting the workpiece is used with an inner chamfer on a nose piece to direct the guide fingers to a closed position. The contact nose is adjustably mounted to properly position the guide finger.

Also of particular note is the magazine body including an upper head to strip positioning finger and a lower strip supporting shoulder that define a head and elastomer aperture, a strip aperture, and a shank aperture.

These and other objects and advantages of the present invention, along with features of novelty appurtenant thereto, will appear or become apparent by reviewing the following detailed description of the invention.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
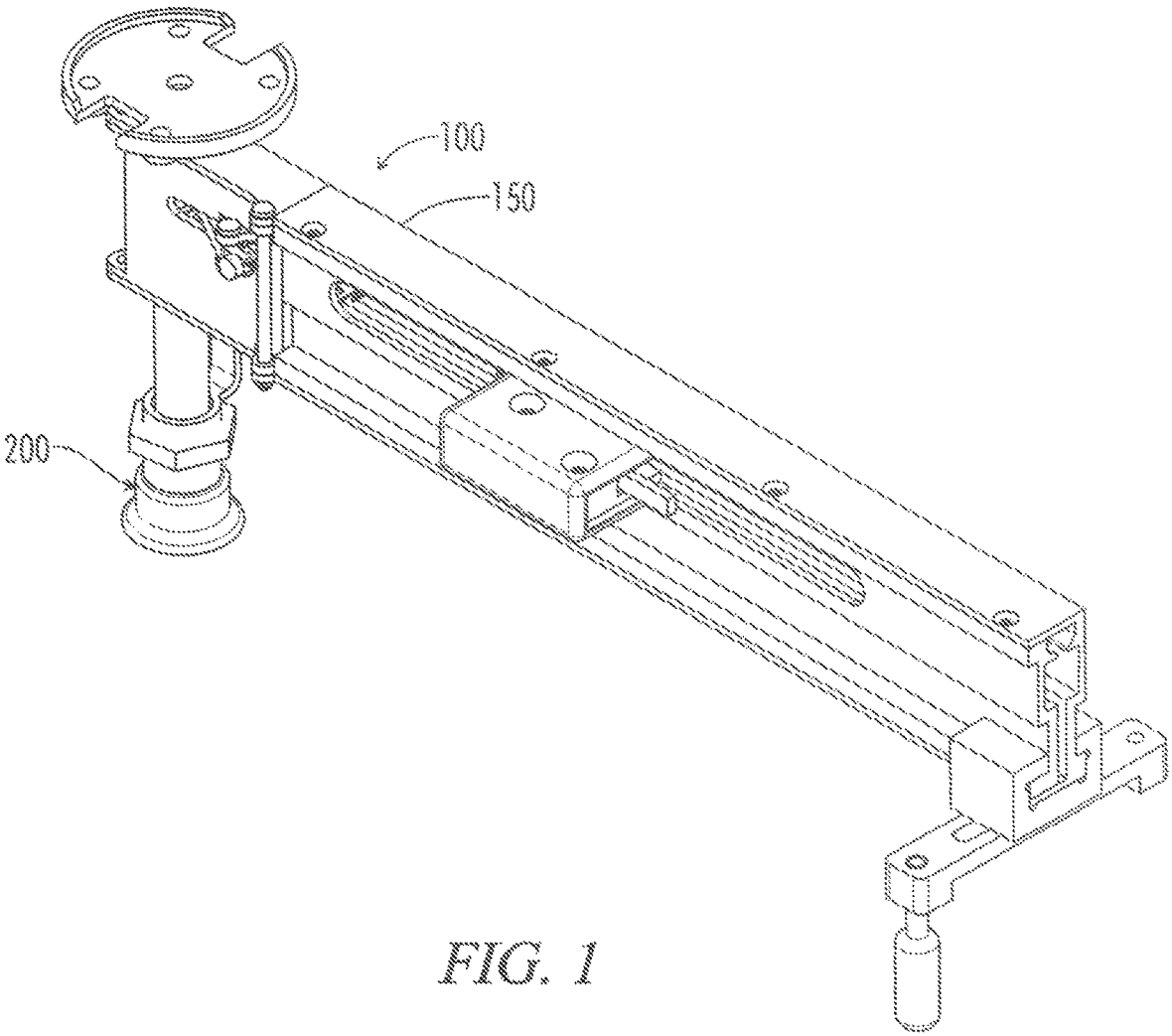
FIG. 1 is an isometric view of a first embodiment of the fastener magazine.

As shown in FIG. 1 of the drawings, an exemplary embodiment of the present invention is generally shown as magazine 100 with a magazine body 150 and a birds beak fastener guide 200.

Figure 2:
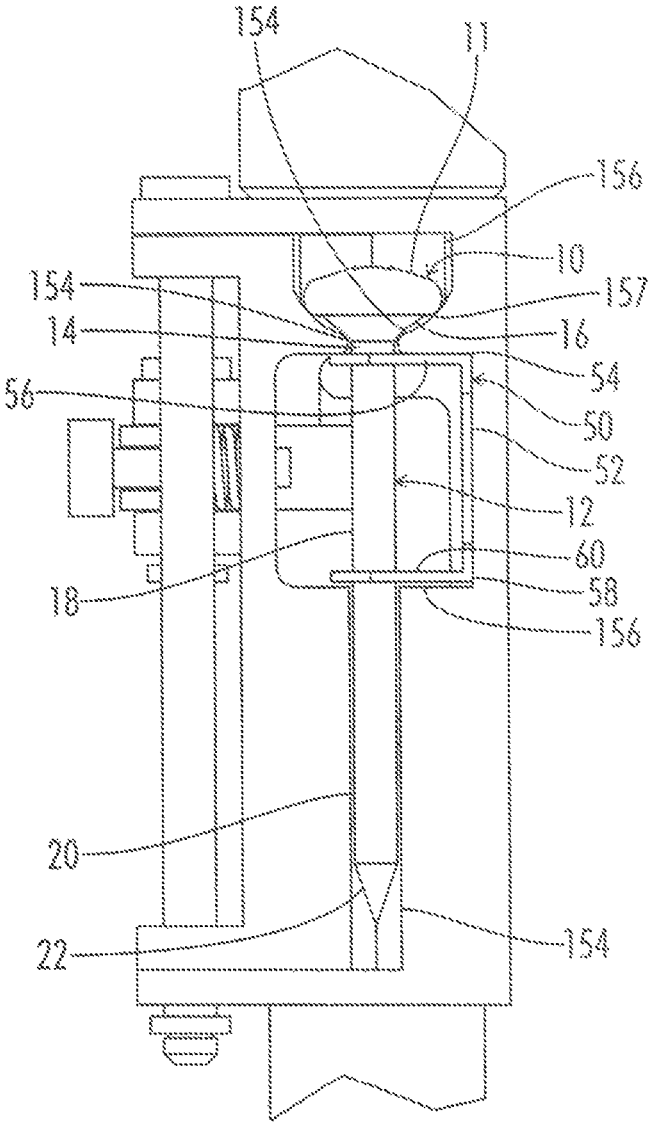
FIG. 2 is a schematic view of the internal aperture and finger layout of the interior of the magazine.
Figure 3:
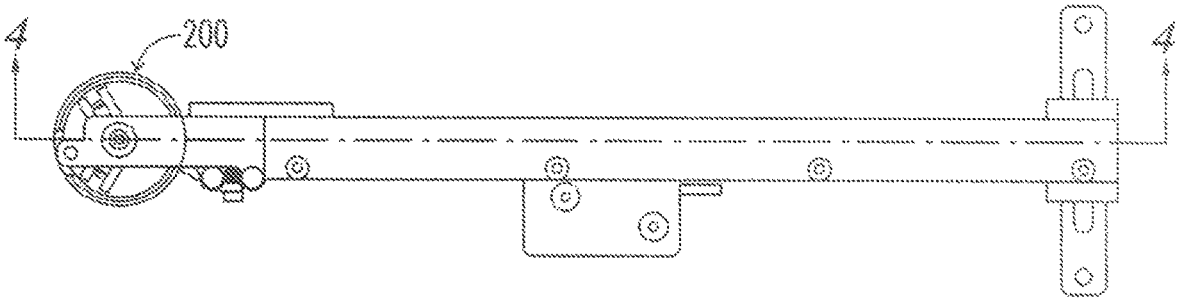
FIG. 3 is a top view of another embodiment of the fastener magazine.
Figure 4:
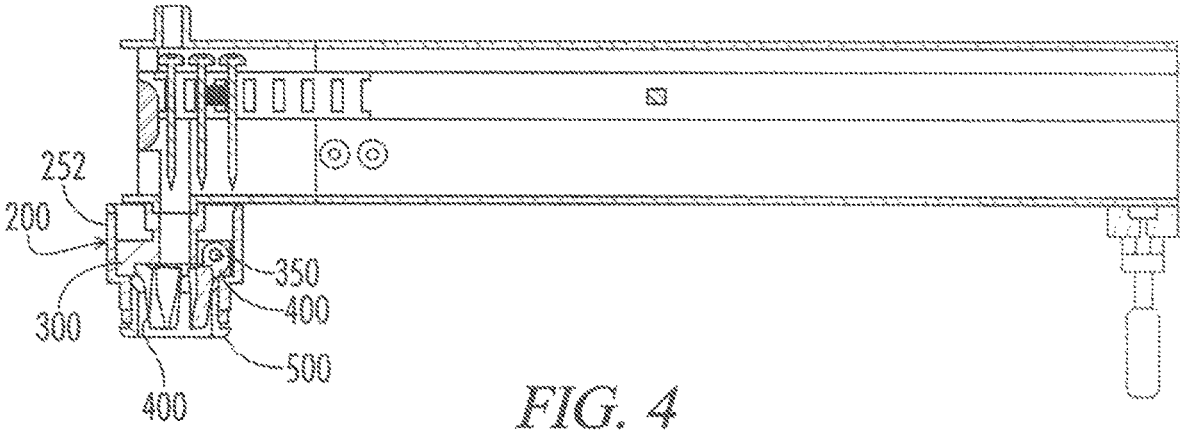
FIG. 4 is a cutaway schematic view of a fastener magazine.
Figure 5:
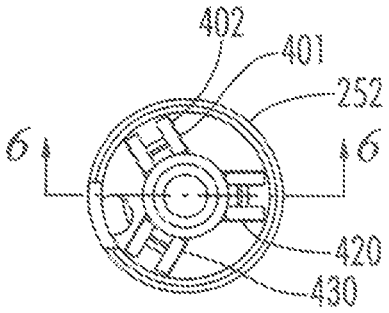
FIG. 5 is a top schematic view of the birds mouth nose piece.
Figure 6:
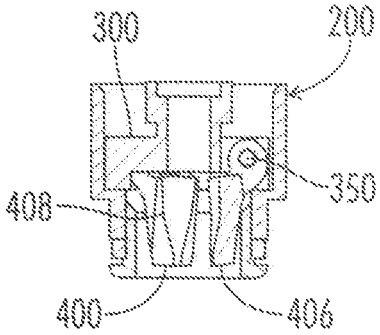
FIG. 6 is a cutaway view of the birds mouth nose piece.
Figure 7:
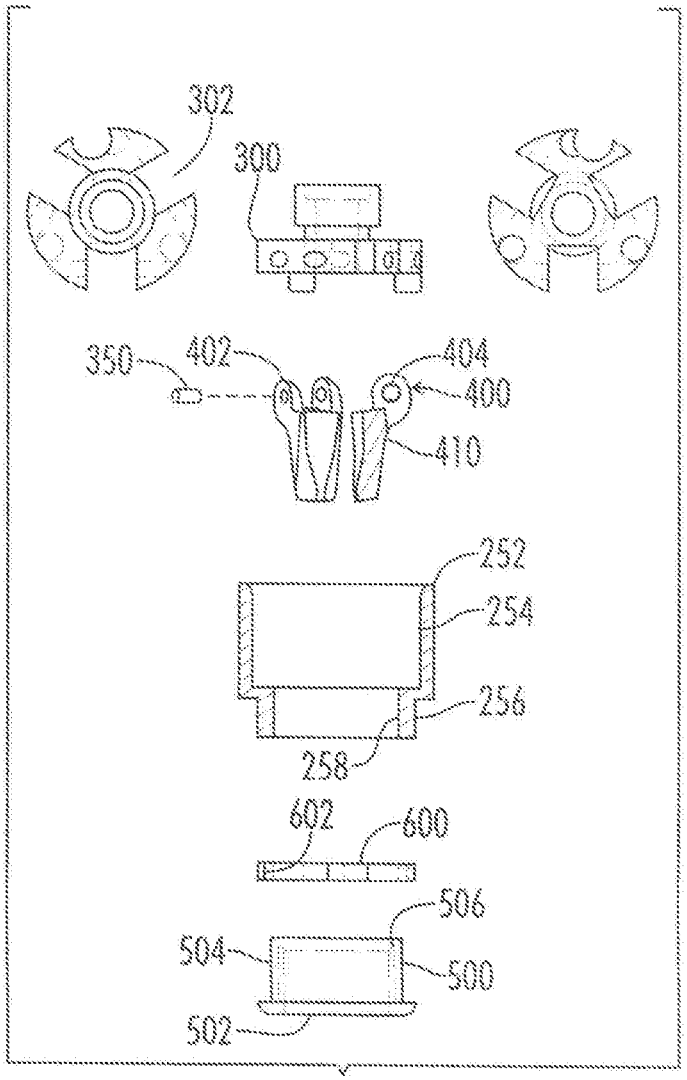
FIG. 7 is a schematic exploded view of the birds mouth nose piece.
Figure 8:
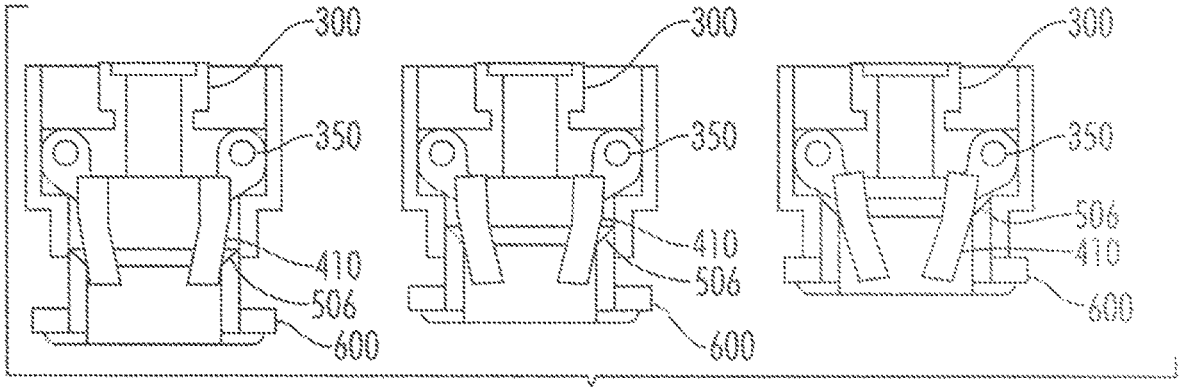
FIG. 8 shows the movement effect of the contact nose being adjusted in relation to the outer housing and fingers.
Figure 9:
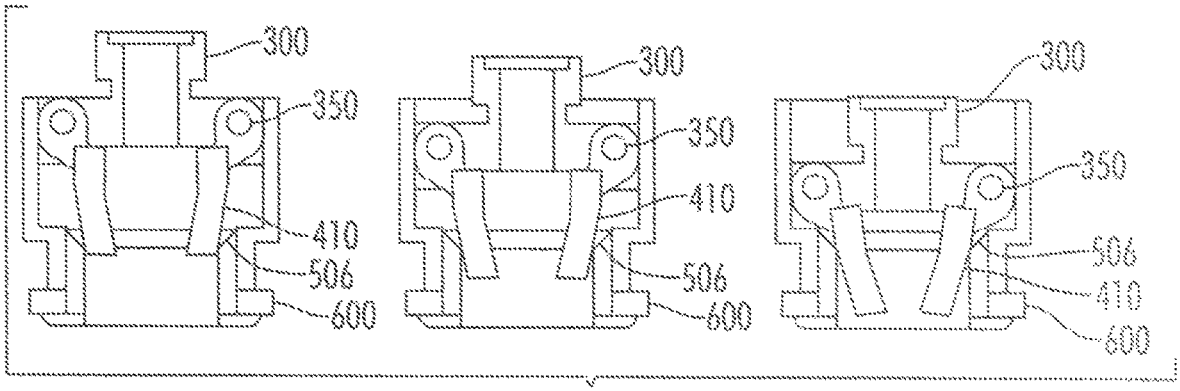
FIG. 9 shows how movement of the outer housing when contacting the workpiece and how this changes the finger position due to the magazine fixed position of the inner support body.

FIG. 2 is a schematic view of the internal aperture and finger layout of the interior of the magazine 100. Here, one can see the particular type of fastener 10 and its uniqueness that demands the inventive aspects of the magazine 100. The fastener 10 includes a head 11 with a shank 12. The shank 12 includes an upper shank 14, mid shank 18 and lower shank 20. The upper shank 14 supports an elastomer 16 for sealing the fastener 10 during installation. The mid shank 18 is used to count the fastener 10 to the collating strip 50, and the lower shank 20 terminates in the tip 22. The collating strip 50 is of a variety known in the art to include a spline 52, upper hinge 54, upper arm 56, lower hinge 58, and lower arm 60. Where the prior art taught to grasp the fastener at the upper shank, here, the upper arm 56 and lower arm 60 are used to secure the fastener 10 at the mid shank 18 to avoid harm to the elastomer 16. The magazine body 150 includes the upper head to strip positioning finger 154 and the lower strip supporting shoulder 156 to support the collated fastener 10 and strip 50 while it passes through the magazine 100. The magazine body defines a fastener aperture 154 with a head and elastomer aperture 156 made by incorporating a sloped head guide surface 157 of the aperture on the upper head to strip positioning finger 154 to contact the head 11 without contacting the elastomer 16. The strip aperture 160 is defined by the bottom of the upper head to strip positioning finger 154 and the the lower strip supporting shoulder 156.

FIGS. 3 through 9 show another inventive aspect of the present invention in the integration of a birds beak fastener guide 200. The birds beak fastener guide 200 utilizes an outer housing 252, inner support body 300, spring pin 350, guide fingers 400, and a contact nose 500.

The outer housing 252 includes an upper mounting aperture 254, a lower nose extension 256, and a threaded nose interior 258. As noted by FIG. 1, the outer housing 252 is connected to the safety arm so that it acts as the probe or work contact element known in the prior art that must be depressed against the work piece to operate the fastener gun. In this manner, the safety is incorporated, and the outer housing 252 can move relative to the magazine 100. The upper mounting aperture 254 is used to slideably retain the inner support body 300. The lower nose extension is used to house the guide fingers 400 and mount the contact nose 500. The threaded nose interior 258 is used for adjustment of the position of the contact nose 500.

The inner support body 300 is mounted by welding to the magazine 100 to provide a secure base for the birds beak fastener guide 200 and is slidably positioned in the upper mounting aperture 254 so that the outer housing 252 can move in relation to the inner support body 300. The inner support body 300 is constructed with hinge apertures 302 for hinging the guide fingers 400 by connecting them with a spring pin 350.

The guide fingers 400 are formed as a first guide finger 401, second guide finger 420, and third guide finger 430. Each guide finger 401, 420, 430 includes upper hinge ears 402 defining pin apertures 404 for the spring pin 350 such that the guide fingers 400 are hingeably connected to the inner support body 300. Each guide finger 401, 420, 430 further includes a lower guide body 406 with an inner guide surface 408 adapted to contact the edge of the fastener head 11 and guide the fastener 10 into position without contacting the elastomer 16. By utilizing three fingers, an ideal minimization of parts and maximizing control is believed to be achieved although differing numbers of fingers is also envisioned. The lower guide body 406 also defines an outer slide surface 410 the is used to contact an upper inner slide chamfer 506 on the contact nose to position the fingers during fastener 10 installation.

The no mar lower contact nose 500 includes a contact face 502 for the workpiece with exterior threads 504 for adjustable mounting to the threaded nose interior 258. In this manner, the position of the upper inner slide chamfer 506 can adjust the positioning of the guide fingers 400. As the upper inner slide chamfer 506 is screwed into to the threaded nose interior 258, the upper inner slide chamfer 506 contacts the outer slide surface 410 of the guide fingers 400. Because the outer slide surface 410 is wedge shaped, this adjusts how much the it closes the fingers 400 together. In operation, the contact nose 500 extends down and the upper inner slide chamfer 506 provides little or no pressure to close the guide fingers 400. In contrast, when the contact nose 500 contacts the work piece and moves in relation to the magazine 100 to depress the safety mechanism on the pneumatic gun, this also moves the upper inner slide chamfer 506 to contact the outer slide surface 410 of the guide fingers 400 and close the fingers together.

Finally, a nose jam lock nut 600 is also provided with interior threads 602 such that it can be mounted on the contact nose 500 and wedge against the outer housing 252 to secure the position of the contact nose 500 in relation to the outer housing 252.

Reference numerals used throughout the detailed description and the drawings correspond to the following elements:

Fastener 10
Head 11
Shank 12
Upper shank 14
Elastomer 16
Mid shank 18
Lower shank 20
Tip 22
Collating strip 50
Spline 52
Upper hinge 54
Upper arm 56
Lower hinge 58
Lower arm 60
Magazine 100
Magazine body 150
Upper Head to strip positioning finger 154
Lower strip supporting shoulder 156
Fastener aperture 154
Head and elastomer aperture 156
Sloped head guide surface 157
Shank aperture 158
Strip aperture 160

Birds beak fastener guide 200
Outer housing 252
Upper mounting aperture 254
Lower nose extension 256
Threaded nose interior 258
Inner support body 300
Hinge apertures 302
Spring pin 35
First guide finger 400
Upper hinge ears 402
Pin apertures 404
Lower guide body 406
Inner guide surface 408
Outer slide surface 410
Second guide finger 420
Third guide finger 430
No mar lower contact nose 500
Contact face 502
Exterior threads 504
Upper inner slide chamfer 506
Nose jam lock nut 600
Interior threads 602

From the foregoing, it will be seen that this invention is well adapted to obtain all the ends and objects herein set forth, together with other advantages which are inherent to the structure. It will also be understood that certain features and subcombinations are of utility and may be employed without reference to other features and subcombinations. This is contemplated by and is within the scope of the claims. Many possible embodiments may be made of the invention without departing from the scope thereof. Therefore, it is to be understood that all matter herein set forth or shown in the accompanying drawings is to be interpreted as illustrative and not in a limiting sense.

When interpreting the claims of this application, method claims may be recognized by the explicit use of the word 'method' in the preamble of the claims and the use of the 'ing' tense of the active word. Method claims should not be interpreted to have particular steps in a particular order unless the claim element specifically referring to a previous element, a previous action, or the result of a previous action. Apparatus claims may be recognized by the use of the word 'apparatus' in the preamble of the claim and should not be interpreted to have 'means plus function language' unless the word 'means' is specifically used in the claim element. The words 'defining,' 'having,' or 'including' should be interpreted as open ended claim language that allows additional elements or structures.

What is claimed is:

1. A birds beak fastener guide apparatus for use with a fastener magazine, the apparatus comprising:

an outer housing defining an upper mounting aperture and including a lower nose extension;

an inner sliding support body defining hinge apertures;

at least one guide finger pivotally mounted to the inner sliding support body, each guide finger including a lower guide body with an inner guide surface and an outer slide surface;

a contact nose mounted to the lower nose extension, the contact nose defining an upper inside slide chamfer adapted to contact the outer slide surfaces to position the at least one guide finger;

the lower nose extension including a threaded nose, and the contact nose further comprising exterior threads engaging the threaded nose to adjustably position the contact nose in relation to the outer housing.

2. A birds beak fastener guide apparatus for use with a fastener magazine, the apparatus comprising:

an outer housing defining an upper mounting aperture and including a lower nose extension;

an inner sliding support body defining hinge apertures;

at least one guide finger pivotally mounted to the inner sliding support body, each guide finger including a lower guide body with an inner guide surface and an outer slide surface;

a contact nose mounted to the lower nose extension, the contact nose defining an upper inside slide chamfer adapted to contact the outer slide surfaces to position the at least one guide finger;

a nose lock nut including threads engaging the contact nose, wherein the nose lock nut also engages the outer housing.

* * * * *